US005296030A

United States Patent [19]

Young

[11] Patent Number: 5,296,030

[45] Date of Patent: Mar. 22, 1994

[54] PAINTING RACK FOR VEHICLE PARTS

[76] Inventor: Robert D. Young, 62516 Orange Rd., South Bend, Ind. 46614

[21] Appl. No.: 956,375

[22] Filed: Oct. 5, 1992

[51] Int. Cl.[5] ..... B05C 13/00

[52] U.S. Cl. ..... 118/500; 211/13; 280/79.3; 280/35

[58] Field of Search ..... 211/189, 13; 280/651, 280/47.35, 79.3, 79.11, 35; 118/500

[56] References Cited

U.S. PATENT DOCUMENTS

| | | | |
|---|---|---|---|
| 2,223,460 | 4/1990 | Newton-Shimpe | 118/500 |
| 3,240,505 | 5/1964 | Schlernitzauer | 280/36 |
| 3,807,750 | 10/1972 | Brown | 280/79.11 |
| 4,984,814 | 1/1991 | Graffunder | 280/79.3 |
| 5,048,849 | 9/1991 | Mathews | 280/47.35 |
| 5,050,898 | 9/1991 | Petrell | 280/79.11 |
| 5,165,552 | 11/1992 | Muhlbauer | 211/13 |

FOREIGN PATENT DOCUMENTS

| | | | |
|---|---|---|---|
| 107315 | 11/1938 | Australia | 280/49 |

*Primary Examiner*—David A. Simmons
*Assistant Examiner*—Mark De Simone
*Attorney, Agent, or Firm*—R. Tracy Crump; James D. Hall; Thomas J. Dodd

[57] ABSTRACT

A painting rack for the mounting of a variety and multiplicity of vehicle parts, the sections of which are designed for ease in assembly and disassembly for storage and transport. The rack defines a hole portion to which can be inserted a plurality of rod-like supports extending outwardly therefrom which are rotatable in a given plane for spacing and counterbalance of the parts mounted thereon.

6 Claims, 4 Drawing Sheets

PAINTING RACK FOR VEHICLE PARTS

This invention relates to an improved painting rack for vehicle parts and more specifically to a painting rack which is capable of supporting a plurality of parts in position for the painting of all sides and edges thereof.

BACKGROUND AND SUMMARY OF THE INVENTION

During the extended life of a vehicle, there are occasions when re-painting of one or more parts is necessary or desired. In the event of an accident or severe rusting, it is general practice to obtain a replacement part. In such instances, the part is not of a color which matches the basic color of the vehicle.

In the context of this invention, we are talking about garages, general vehicle repair, collision shops and specialty paint shops. Such shops have dozens of parts waiting to be painted. To compound the problem, the parts should be painted completely, i.e., inside, outside and edges.

There are currently available on the market, paint stands of various designs. All known stands are much like a table with a tilting top, upon which the part is rested. The obvious problem with such devices is that only one side of the part can be painted at a time. When one side is dry, the part is turned over and the other side is painted.

Some painters suspend parts from rafters, and this works fairly well until one considers that these parts are at arm level. Swinging parts tend to strike against each other and the shop becomes somewhat dangerous to walk around in.

The painting rack of this invention is an inexpensive and practical solution to the problems outlined above, and comprises a rack structure which not only supports certain vehicle parts, but which includes arms on which other parts may be suspended. The rack is designed for ease of assembly and disassembly and can be transported in a small van, pick-up truck or in the trunk of an automobile.

Accordingly, it is an object of this invention to provide an improved painting rack which is of sufficient strength to support several vehicle parts simultaneously.

It is a further object of this invention to provide such a painting rack on which parts are suspended in such positions that both sides, top, bottom and edges of such parts may be painted at the same time.

It is a still further object of this invention to provide an improved painting rack with a variety of receptacles for the extensions in order that any of a variety of positions for parts may be obtained.

Further and other objects will become apparent upon consideration of the detailed description of the preferred embodiment of the present invention.

BRIEF DESCRIPTION OF THE DRAWINGS

The present invention is illustrated hereinafter by a detailed description of the present embodiment, which is presented in conjunction with, and by reference to, the accompanying drawings, in which like reference characters refer to like or corresponding parts, and wherein.

DETAILED DESCRIPTION OF THE PREFERRED EMBODIMENT

Figure 1:
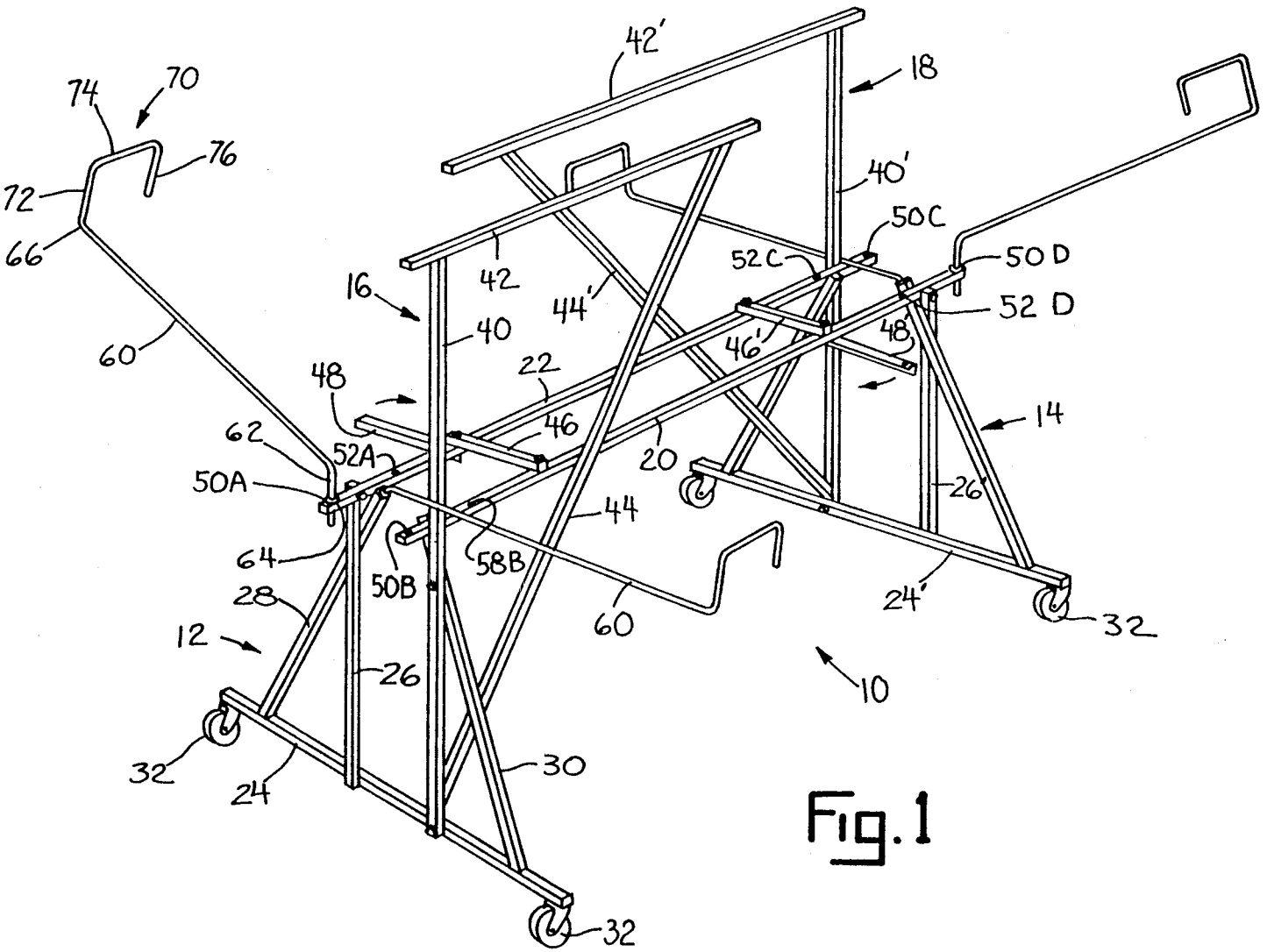
FIG. 1 is a perspective view of the painting rack, with arms outstretched, indicating the structure of this invention.

The preferred embodiment illustrated is not intended to be exhaustive or to limit the invention to the precise form disclosed and depicted in the drawings. It has been chosen and is herein described in order to best explain the invention and its practical use to enable others skilled in the art to best utilize the invention.

Certain terminology will be used in this description for convenience in reference only and will not be limiting. For example, the words "upwardly", "downwardly", "leftwardly" and "rightwardly" will refer to directions in the drawings to which reference is made. The words "inwardly" and "outwardly" will respectively refer to directions toward and away from the geometric center of the painting rack and designated parts thereof. Said terminology will include the words specifically mentioned, derivatives thereof, and words of similar import.

The painting rack of this invention has been illustrated as being constructed of tubular steel having a square cross-section. The inventor prefers such tubing for its ease of drilling, welding, assembly and disassembly, but it will be obvious that the painting rack may be composed of tubular steel, or any other acceptable material of sufficient strength and rigidity to serve its intended purpose, of circular cross-section, or a combination of stringers of circular and square cross-section. For example, the uppermost horizontal support could easily be of circular cross-section.

Four outwardly extending arms are illustrated, but it will be obvious from a review of the drawings that only one-third of the bores are being utilized. It will also be obvious to one who understands the invention that as many arms that fit without prohibiting movement and without interfering with other parts may be employed. For example the central horizontal supports may contain any desired number of bores to accommodate any number of arms.

Finally, and as will be explained in more detail subsequently, the arms may be bent to any desired angle and only one of a myriad of possibilities is herein illustrated.

Referring now to the figures, and particularly to FIG. 1, reference numeral 10 generally designates the painting rack of this invention. Rack 10 is designed so to by symmetrical and with interchangeable parts, for economy of manufacture and for ease of assembly, disassembly, transport and storage.

Rack 10 is comprised of two vertical end sections 12, 14, to which are attached, one to each end, upwardly extending vertical sections 16, 18, and two horizontal bars 20, 22, which establish the distance between and secure end sections 12, 14, together into its self-sustaining configuration.

It will be obvious that end sections 12, 14 are interchangeable, both being identical but opposite when facing each other, that vertical sections 16, 18 are identical and that horizontal bars 20, 22 are likewise identical. It should now also be obvious why the inventor has selected square, or flat surfaced, tubular steel for the members.

In order to obviate any possible confusion and to simplify the explanation, only one of each of these members will be described in detail, it being understood that the details pertain equally to both of the corresponding members.

Taken by itself, end section 12 is comprised of a bottom horizontal bar 24, vertical bar 26, secured to horizontal bar 24, preferably by welding, at a point approximately one-third the length of horizontal bar 24 from the left, as one looks at the drawings, and two inwardly-angled vertical bars 28, 30.

Bars 28, 30 are welded to the horizontal bar 24 at points a short distance inside the ends thereof. Bar 28 is angled to intersect vertical bar 26 a short distance from the top thereof and is of a length such that the tops of the bars are approximately level. Bars 26 and 28 are welded together at the point of intersection.

Bar 30 is the same length as bar 28, is welded to horizontal bar 24 at a point opposite to that point where bar 28 is welded to horizontal bar 24, is placed at the same angle, facing inwardly toward, but not extending to, bar 28, but is free-standing.

Recapitulating, vertical end section 12 is comprised of four bars, one horizontal 24, one vertical 26 and two 28, 30 angularly vertically inclined toward one another, one of which 28 is welded to vertical bar 26.

At a point equi-distant from the right end of horizontal bar 24 as vertical bar 26 is from the opposite end, is drilled a horizontal bore. The bore is hidden in the figures, but may be "seen" in FIGS. 1, 2 and 4, hidden by a bolt, which extends therethrough.

A base is drilled through vertical angling bar 30 at a point corresponding to the point at which corresponding bar 28 is welded to vertical bar 26, perpendicularly to the plane of end section 12. Finally, a bore is drilled into vertical bar 26 a distance approximately one half the thickness of the bar, parallel to the plane of end section 12.

As may be seen in all of the figures, painting rack 10 is provided with wheels 32, secured at or near the ends of horizontal bars 24, 24', in conventional fashion, for mobility.

As in the instance of end sections 12, 14, upwardly extending vertical sections 16, 18, are identical. As a consequence, only one will be described in detail. Vertical sections 16, 18 are parallel one to the other and parallel to a vertical plane extending between and perpendicular to end sections 12, 14. Vertical sections 16, 18 are triangular in shape, two legs of which are perpendicular to one another, constituting vertical section 16 as a right triangle, but one in which the perpendicular legs are not necessarily of equal length.

Vertical section 16 may be spatially described, but will be nevertheless explained in context of its position relative to end section 12 and to rack 10 generally. As a right triangle, vertical section 16 obviously has three sides. Side 40 is vertically oriented with respect to rack 10, side 42 is horizontally oriented and side 44 is the hypotenuse of the triangle.

Vertical bar 40 extends perpendicularly from horizontal bar 24 and is of a length approximately half again that of vertical bar 26. The top of vertical bar 40 is welded to horizontal bar 42 at a point near to, but not at, the end thereof.

Bar 44, constituting the hypotenuse of the triangle, extends from a point near the bottom of vertical bar 40, to a point near the end of horizontal bar 42 which is opposite the point at which bars 40 and 42 are joined. The ends of bar 44 are welded to bars 40 and 42.

A bore is drilled through vertical bar 40 at the "bottom" thereof in a plane parallel to the plane of vertical section 16, i.e., perpendicular to the plane of end section 12. A second bore is drilled through vertical bar 40 at a point corresponding to the bore which is drilled through vertical angling bar 30. A third bore is drilled through vertical bar 40 at a point corresponding to the bore which is drilled near the top of vertical bar 26.

As in the case of the previous sections, right 20 and left 22 horizontal bars are identical. Consequently, only one will be described in detail. Horizontal bars 20, 22 determine the distance between end sections 12 and 14 and constitute the horizontal bond to unite and form rack 10.

Distance and sizes are relative and not critical, and have been established by the general size of the parts to be mounted on the painting rack. Horizontal bars 42, 42' are generally configured to support the fender of automobiles, with the outer surface facing outwardly from the painting rack. For freedom of placement and movement, horizontal bars 42, 42' "overlap", but individually do not extend from the end to which they are bolted to the opposite end of the painting rack.

It has been stated previously that vertical bar 26 is welded to horizontal bar 24 at a point approximately one-third the distance from the end thereof. This is not a critical distance, and it will be understood that the distance between vertical bars 26 and 40 may be much less, the only critical dimension being that enough space is given to allow vehicle parts to be mounted on painting rack 10.

A short distance from each end of horizontal bars 20, 22 are drilled horizontal bores, perpendicular to the centerline of horizontal bar 20. These bores are for the insertion of bolts to connect horizontal bars 20, 22 to vertical bars 40, 26' and 26, 40' respectively.

At a point approximately one inch from the ends of horizontal bars 20, 22 are drilled vertical bores 50 *a, b, c*, and *d*, the purpose of which is obvious from viewing the figures, but which will be subsequently explained.

Additional vertical bores 52 *a, b, c*, and *d*, only four of which are illustrated, may be drilled along the length of horizontal arms 20, 22.

At a point approximately one-fourth the distance inwardly from the ends of horizontal bars 20, 22 are drilled four vertical bores, two in each horizontal bar. These bores are complementary and accommodate short cross-members 46.

Viewing FIG. 1, cross-members 46, 46' are seen to the left and right of painting rack 10, connecting horizontal bars 20, 22. Projecting toward the viewer, at the right side, may be seen a short angle iron 48'. Corresponding angle iron 48 projects outwardly from the far side of painting rack 48 and away from the viewer. The legs of angle irons 48, 48' are generally, but not necessarily, of the same dimension as the sides of the square tubular bars used in the structural components of painting rack 10.

Angle irons 48, 48' are secured by the same bolts which secure cross-members 46, 46' to horizontal bars 20, 22, in such fashion that angle irons 48, 48' may be pivoted in a horizontal plane outwardly to the position shown in the figures or inwardly to a position underneath horizontal bars 20, 22.

With the exceptions hereinafter described, the ends of all of the tubular bars may, but are not required to, be capped by any conventional means desired. This is more a matter of safety and convenience, to cover potentially sharp edges and corners which could scratch an individual or mar a vehicle part.

The upwardly facing ends of inwardly angled bars 28, 30 and 28', 30' are left open, in order to accept and to support rods 60. In the figures, there are four rods 60 illustrated, all of which are identically formed.

Figure 4:
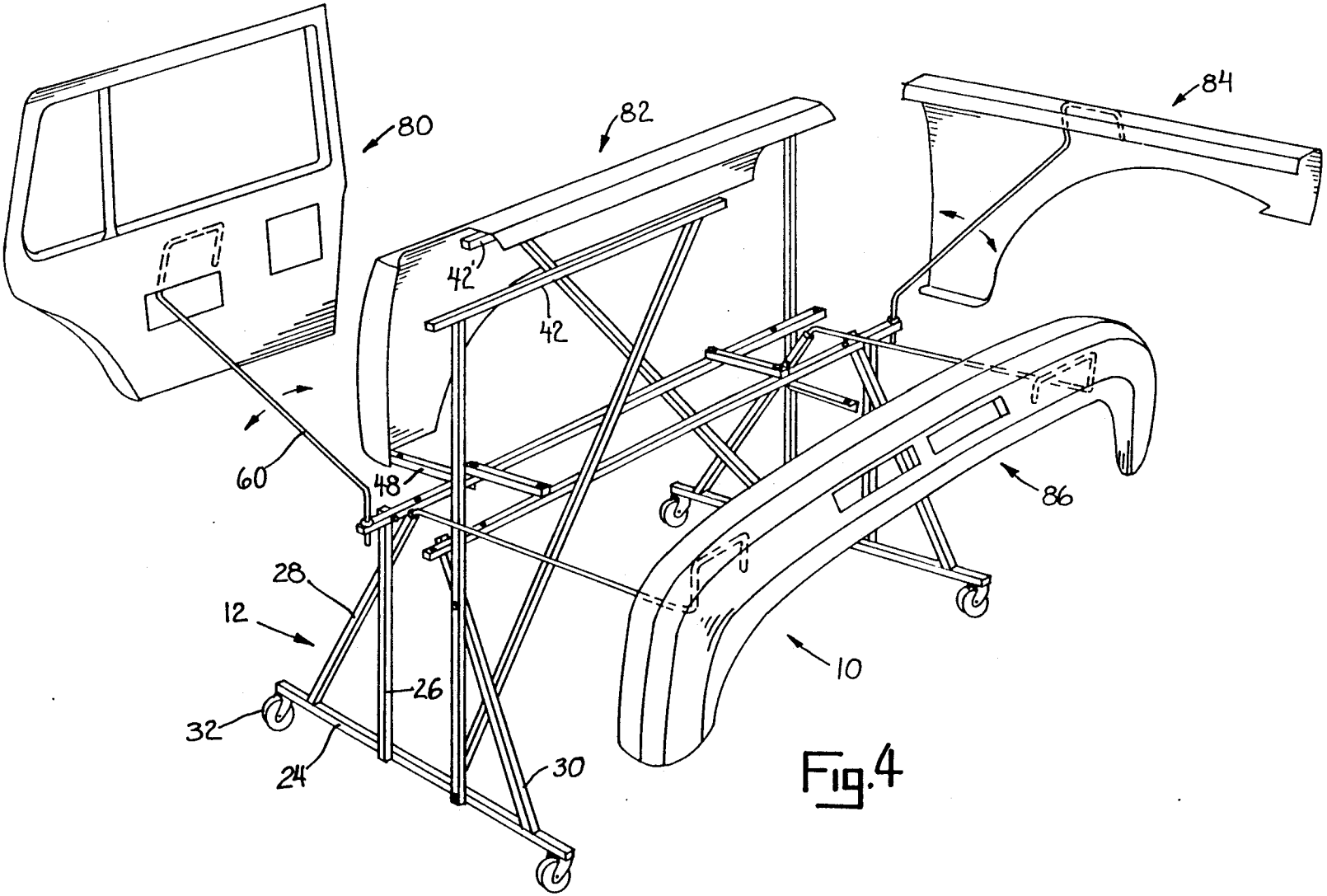
FIG. 4 is a perspective view of the painting rack of this invention with an array of parts mounted on the rack itself and on the arms thereof, to exemplify one way in which such parts may be mounted for painting.

As is illustrated in FIG. 4, rods 60 support various vehicle parts. Since all four of rods 60 are illustrated as the same, only one will be described in detail. The diameter of rod 60 is such that it has sufficient strength and rigidity to support the part which is to be painted.

It has been determined by experience that a ½" rod will support most vehicle parts. If an extremely heavy part is to be supported, it may be supported by two or more rods, as is seen in FIG. 4, wherein a bumper is illustrated so supported.

For added strength and to extend the useful life of painting rack 10, each of the bores into which rods 60 are to be inserted, i.e., 50*a–d* and 52*a–d*, may contain a sleeve of conventional design.

Figure 2:
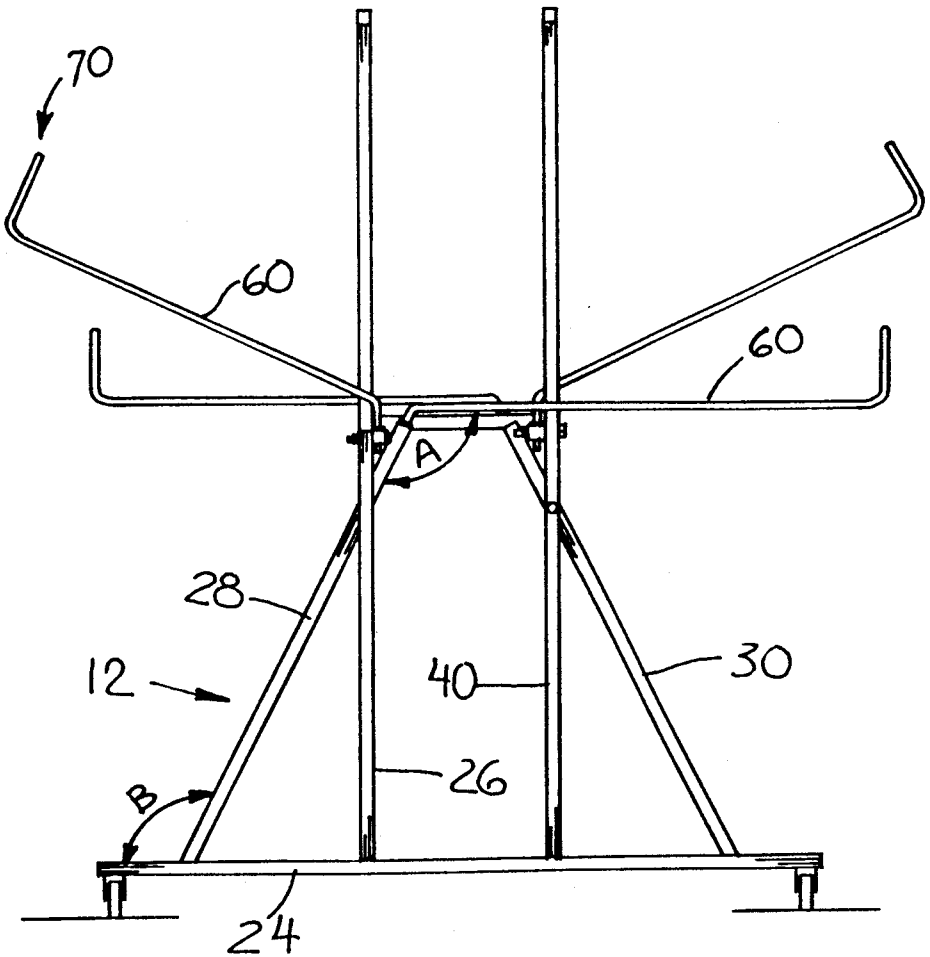
FIG. 2 is an end view of the painting rack of this invention.
Figure 3:
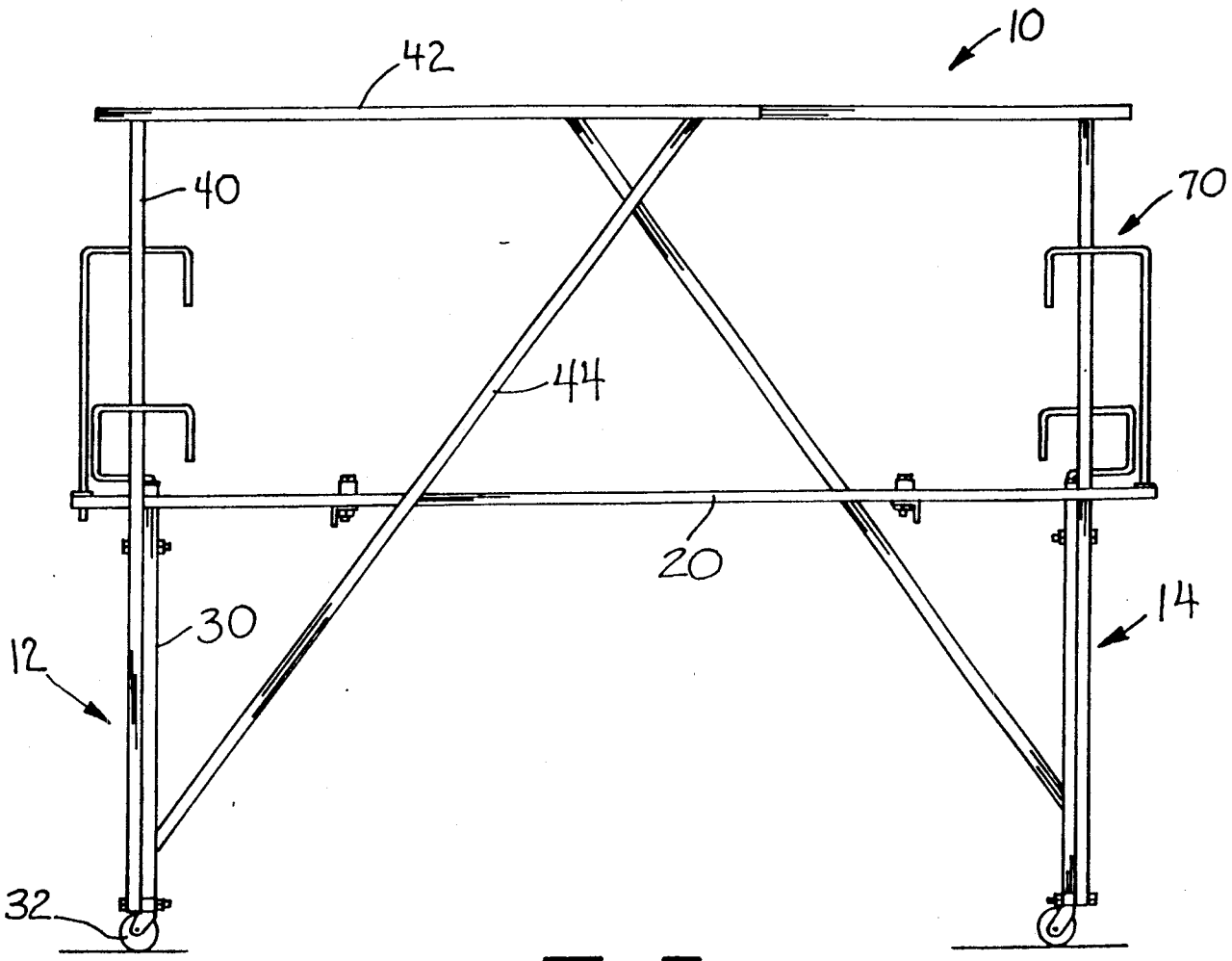
FIG. 3 is a side view of the painting rack of this invention.

A short segment 62 at one end of rod 60 is bent at a desired angle from the centerline of the shaft of rod 60. For purposes of illustration, and as is best seen in FIG. 2, if angle A of rod 60 is generally equivalent to angle B, between horizontal bar 24 and inwardly angled bar 28 of end section 12, then rod 60 will extend in a generally horizontal plane away from and relative to bar 28 and to painting rack 10.

When another rod 60, with the same angle A, is inserted in, e.g., bore 50*a* the opposite end, that to which the vehicle part is mounted, is elevated from the horizontal and at a different level.

It will be understood that angle A must be an obtuse angle, that it can be greater than obtuse angle B but that it cannot be less than obtuse angle B or rod 60 will interfere with other structure within painting rack 10.

Let us return for a moment to the opposite end of rod 60, that to which the vehicle part is mounted. A length of the opposite end 66 of rod 60 is bent into a generally elongated inverted U-shaped part support 70.

The first bend, that which forms arm 72 of U-shaped support 70, is in the same plane as opposite short end 62, but is in a direction opposite to the bend which forms end 62. That is to say, if one can consider end 62 to be bent "down", arm 72 is bent "up".

The next bend, which forms base 74 of support 70, is in a plane perpendicular to the plane formed by rod 60 and arm 72, and at a right angle thereto.

Finally, the small end is bent "downwardly" from the bottom 74 of U70, in the same plane therewith, to complete inverted U-shaped support 70.

As may be best seen in FIG. 2, the angle between rod 60 and segment 72 of U-shaped support 70 is illustrated as being a right angle. This is the angle chosen and preferred by the inventor, but it will be obvious that the angle may be modified without departing from the invention.

If a door is used as an example, there is a limited amount of space into which to insert support 70. It has been found that if portion 74 of support 70 is approximately one-and-one-half the length of portion 72 and if portion 76 is slightly shorter than 72, and if portion 72 is no more than four inches, support 70 will fit and support most vehicle doors.

The length of portion 74 is sufficient to prevent a door, or a fender, as depicted in FIG. 4, from wobbling. If inverted U-shaped support 70 is at an angle with respect to true verticality, the vehicle part is prevented from swinging.

Secured to rod 60, relatively intermediate short portion 62, preferably by welding is a washer-like flange 64. Flange 64 prevents rod 60 from extending through bores 50*a–d* and 52*a–d*, and serves as the "base" upon which rod 60 may be "rotated".

Generally speaking, this provides for four rods 60 which extend outwardly from bars 28, 28', 30 and 30' in a horizontal plane from the sides of painting rack 10. It provides four rods 60 which extend outwardly from the lips of bars 20, 20, from the ends 12, 15 of painting rack 10 and which can be rotated into an unlimited multiplicity of angles therefrom.

It will be appreciated that, with ring 64 fixed to rod 60, and the tip of end 62 inserted into bore 50*a*, for example, the rotation of rod 60 is only limited by other rods and the structure of painting rack 10. If it were not for the other structure, the totality of rod 60 would rotate completely around in the imaginary form of an inverted cone.

The reason that this is important, is that, if so rotated, portion 74 of U-shaped support 70 remains in a horizontal plane over the entire circumference of such an imaginary circle.

It will be obvious that, by varying the angle of which tip portion 62 is bent, one can vary the height at which support 70 supports a given vehicle part. Also, if two rods 60 have the same angle A and are of the same length, one can be inserted in bore 50*a* and the other in bore 50*b* to jointly support, e.g., the bumper of FIG. 4 at the end rather than at the side.

The weight and bulk of the various vehicle parts generally dictates their positioning on painting rack 10. Parts are mounted in counter-balancing positions.

Let us turn now to FIG. 4 and walk through the mounting of a variety of vehicle parts on a painting rack. Only four parts are illustrated in order not to hide or obscure the essential compounds of painting rack 10.

Since this is hypothetical, it is illustrative and not restrictive of a procedure which could but would not necessarily be followed. A painter would first mount fender 82 on horizontal bar 42'. Since bar 42 is somewhat elongated, he need not be concerned with "wobble". It will be noted, however, that angle iron 48 has been rotated to its most extended position, perpendicular to horizontal bar 22. Angle iron 48 engages fender 82 in order to eliminate any possible swinging. In other words, angle iron 48 in effect holds fender 82 at an angle from vertical.

Another fender could or would be similarly mounted on horizontal bar 42.

Next, door 80 might be mounted on support 70 of one of rods 60 which has been inserted into bore 50*a*. Door 80 would not necessarily be in the position shown in FIG. 4, for balance and weight distribution, but may be extended outwardly along a plane more closely aligned with the center of painting rack 10 rather than to the side. This is generally the position in which fender 84 is illustrated.

If he were to feel that one door plus one fender were equal in weight to one bumper, then the painter would most likely mount fender 84 next and check the balance and stability of painting rack 10.

A part which is as cumbersome as bumper 86 may be unstable if mounted on a single support. Accordingly, the painter would then mount bumper 82 on two outwardly extending support rods 60. Since these side supports, as explained previously, are not generally designed to be rotatable, the positioning of bumper 86 is considered to be relatively constant.

It should be noted, however, that, depending on other parts to be painted, bumper 86 could be end-mounted on a pair of rods 60 inserted in bores 50*a* and 50*b*.

In the present illustration, however, the painter would adjust the positions of door 80 and fender 84 to counterbalance bumper 86.

Needless to say, we have accounted for only four of a total of at least twelve rod supporting bores. How these are utilized can be limited only by the imagination of the painter.

In addition, as previously mentioned, horizontal bars 20, 22 may include a plurality of bores 52 in which additional rods 60 may be inserted. Given different angles to rods 60 and different sizes, an array may be mounted on painting rack 10 which is only limited by the size of the parts mounted thereon. As one further and final example, additional parts could be suspended above bumper 86, as it is illustrated and mounted on the side of the painting rack in FIG. 4.

Although the invention has been described and illustrated in detail, it is to be clearly understood that the same is intended by way of illustration and example only and is not to be taken by way of limitation. The preferred embodiment may be modified without departing from the scope of the invention as defined in the appended claims.

I claim:

1. A painting rack for mounting a plurality of articles to be painted, said rack comprising first and second end sections connected by first and second generally parallel horizontal members, first and second elongated triangular members connected to said end sections and to one of said horizontal members, and a plurality of rod members detachably connected to said horizontal members, each triangular portion having an upper horizontal arm spaced above and generally parallel with respect to said horizontal members, each arm constituting means for supporting one of said articles in a spaced relationship, each horizontal member having a plurality of bore spaced along the length therein, said rod members inserted within said bores and outwardly extending from said rack to enable said articles to be suspended therefrom without engaging other said articles.

2. The rack of claim 1 wherein each rod member includes an end located bent portion forming a contact accepting configuration for engaging said article.

3. The rack of claim 1 and further including an extension part pivotally connected to one of said horizontal members, said extension part shiftable between a first position adjacently positioned to one of said horizontal members, and a second position spaced from the horizontal member whereby said articles are spaced away from the horizontal member with the extension part in said second position.

4. The rack of claim 1 wherein said triangular members are in opposing face-to-face orientation.

5. The rack of claim 1 wherein each triangular member forms a portion of one of its said end sections.

6. A painting rack for mounting a plurality of articles to be painted, said rack comprised of a base structure including end sections connected by two elongated triangular portions, the upper arms of which are parallel one to the other and in a horizontal mode, said arms so structured as to accommodate at least two of said articles in spaced relationship, said base structure further including two intermediately spaced horizontal members between said end sections, said intermediate horizontal members having a plurality of bores spaced along the length thereof, such that a series of rod members inserted therein extend from said painting rack in all directions outwardly from said painting rack to enable articles suspended therefrom to be painted without interference with other articles similarly suspended.

* * * * *